US005641035A

United States Patent [19]

Pettit

[11] Patent Number: 5,641,035

[45] Date of Patent: Jun. 24, 1997

[54] COMBINATION POOL LADDER, FENCE AND ADJUSTABLE MULTI-LEVEL DECK

[76] Inventor: Frederick M. Pettit, 2111 Merrittville Hwy., RR#1, Fonthill, Ontario, Canada, L0S 1E0

[21] Appl. No.: 333,413

[22] Filed: Nov. 2, 1994

[51] Int. Cl.[6] ..... E06C 1/39

[52] U.S. Cl. ..... 182/86; 182/118

[58] Field of Search ..... 182/86, 118, 82, 182/113, 93, 106, 115; 472/116

[56] References Cited

U.S. PATENT DOCUMENTS

| | | | |
|---|---|---|---|
| D. 250,783 | 1/1979 | Dieter | 472/116 X |
| 2,962,112 | 11/1960 | Ramsberger | 182/82 X |
| 3,288,248 | 11/1966 | Gurian | 182/118 |
| 3,428,146 | 2/1969 | Bair | 182/118 |
| 3,529,695 | 9/1970 | Rowley | 182/115 |
| 3,586,124 | 6/1971 | Kunzweiler et al. | 182/97 |
| 3,964,572 | 6/1976 | Gannon | 182/118 X |
| 3,969,871 | 7/1976 | Ewers | 472/116 |
| 3,991,851 | 11/1976 | Gannon | 182/86 |
| 4,023,647 | 5/1977 | Confer | 182/108 |
| 4,603,758 | 8/1986 | Pettit | 182/194 |

*Primary Examiner*—Alvin C. Chin-Shue
*Attorney, Agent, or Firm*—Joseph P. Gastel

[57] ABSTRACT

A combination pool ladder structure, fence and adjustable multi-level deck for an above-ground swimming pool having a wall which extends above the level of the ground including a frame for mounting proximate the external side of the wall, a first ladder pivotally mounted on the frame leading to a lower deck which is below the level of the top of the wall, railings on opposite sides of the lower deck, an upper deck adjustably mounted on the frame above the top of the wall, a second ladder pivotally mounted on the frame proximate the inner surface of the wall, the pivotal mountings of the first and second ladders permitting them to be swung to outwardly extending out-of-the-way positions.

13 Claims, 6 Drawing Sheets

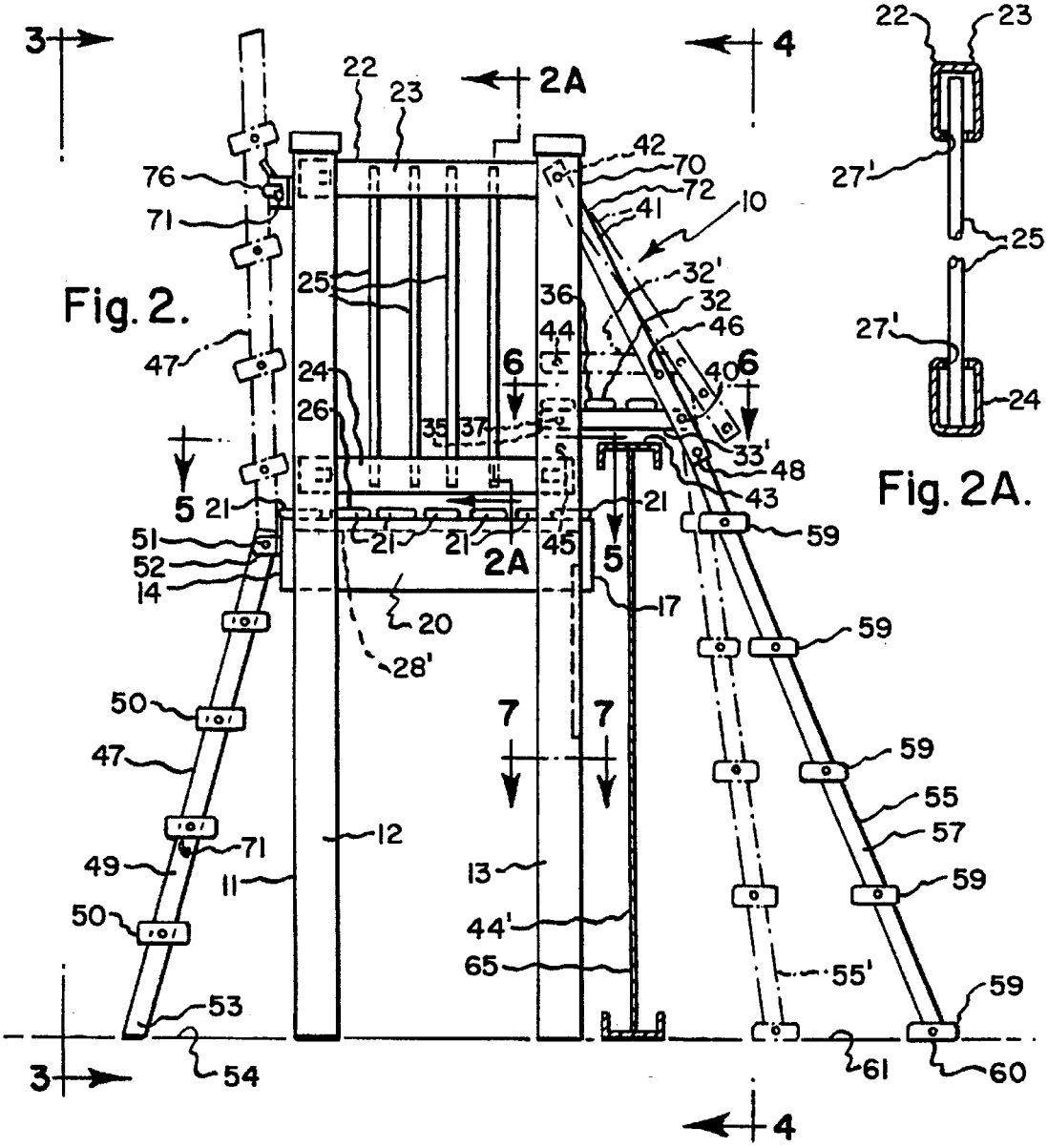
Fig. 2.
Fig. 2A.
Fig. 7.
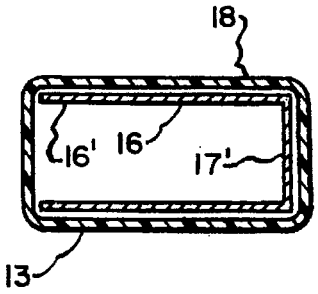
Fig. 8.
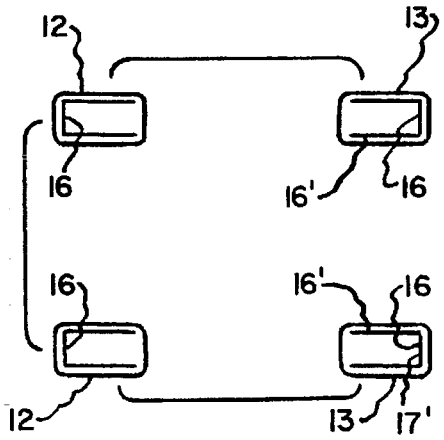

Fig. 3.
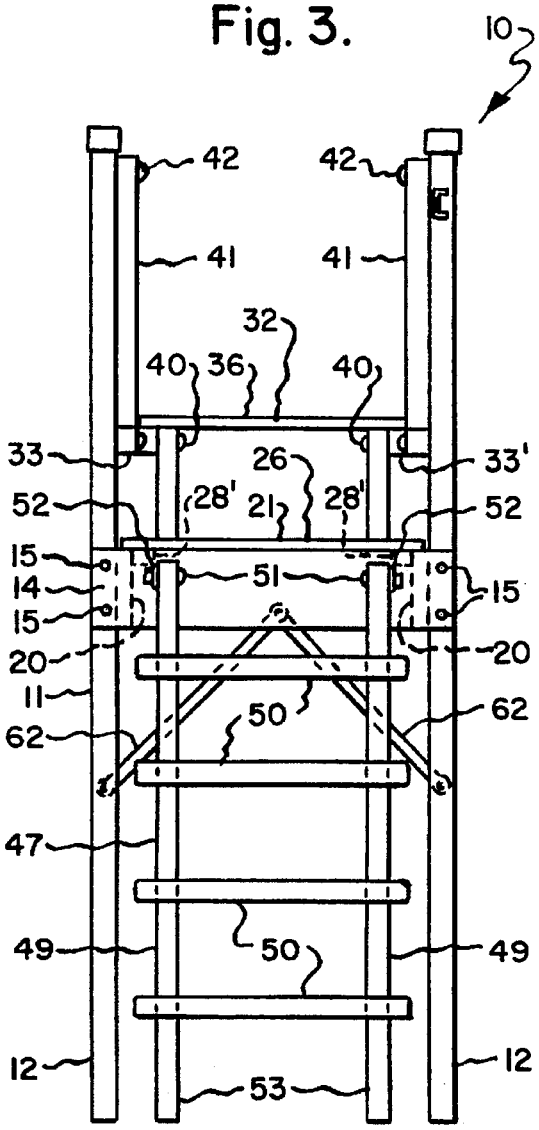
Fig. 4.
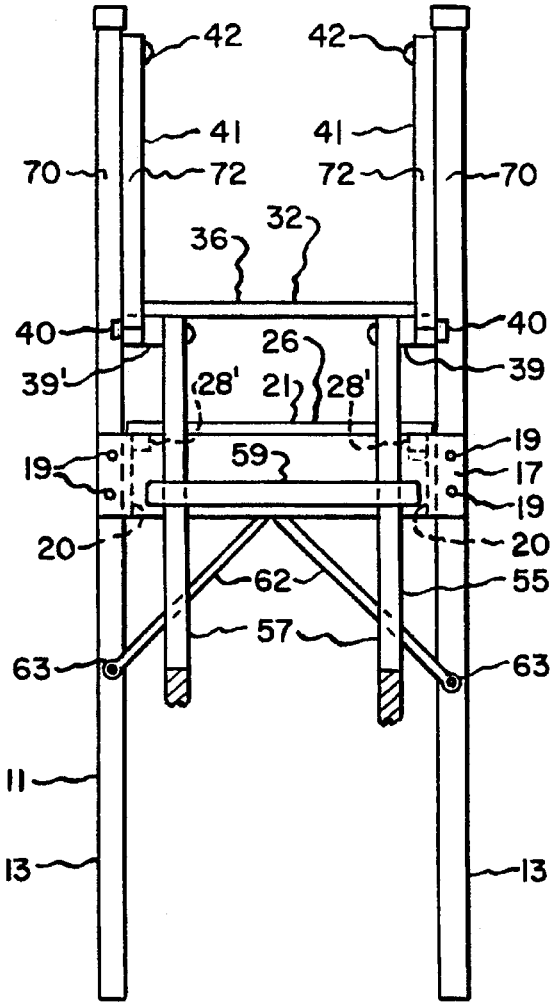
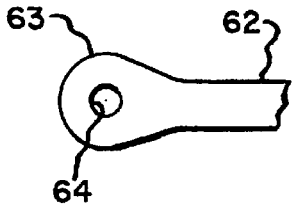
Fig. 11.
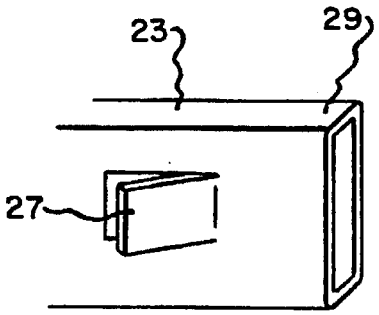
Fig. 9.
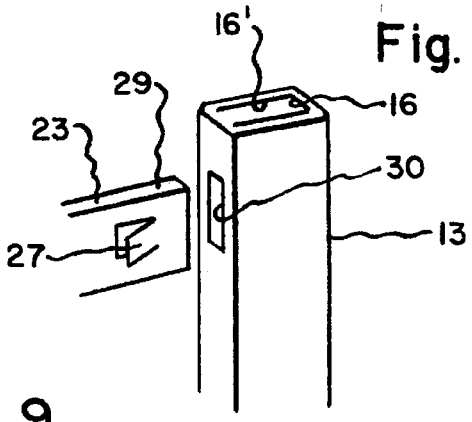
Fig. 10.

Fig. 5A.
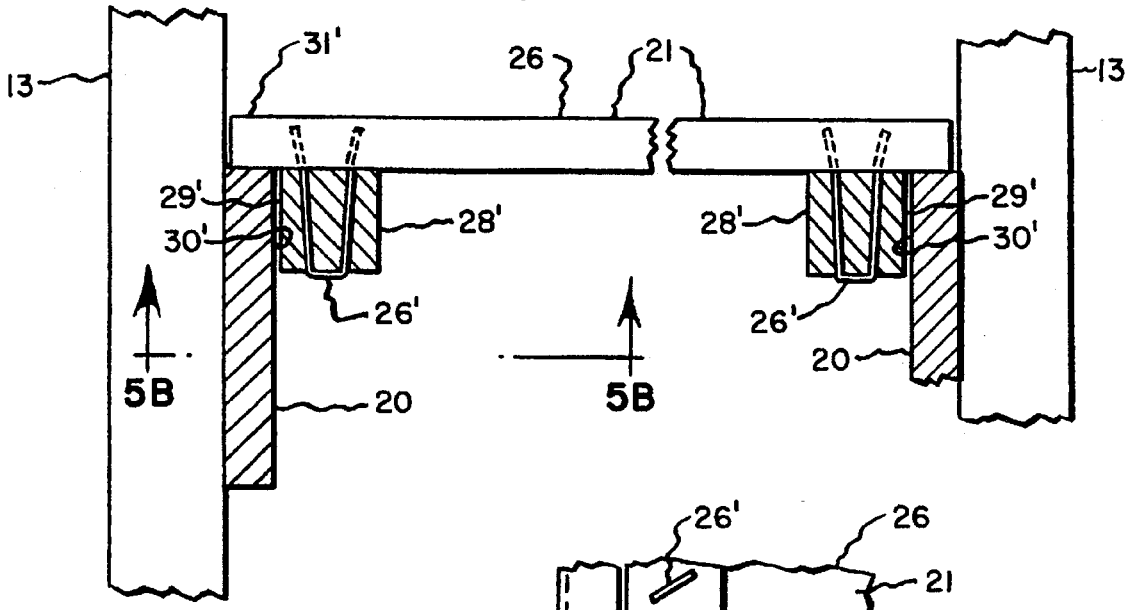
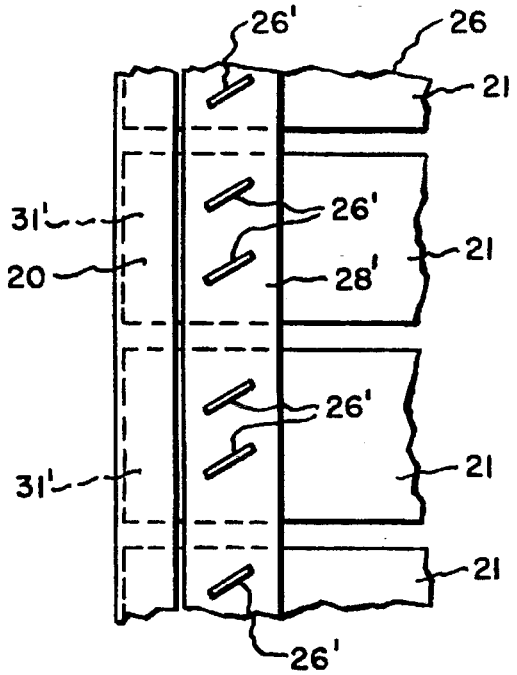
Fig. 5B.
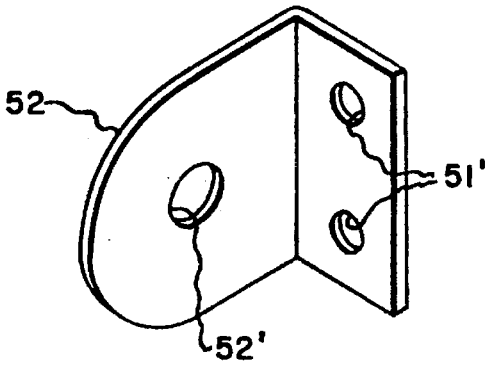
Fig. 5C.

Fig. 13.
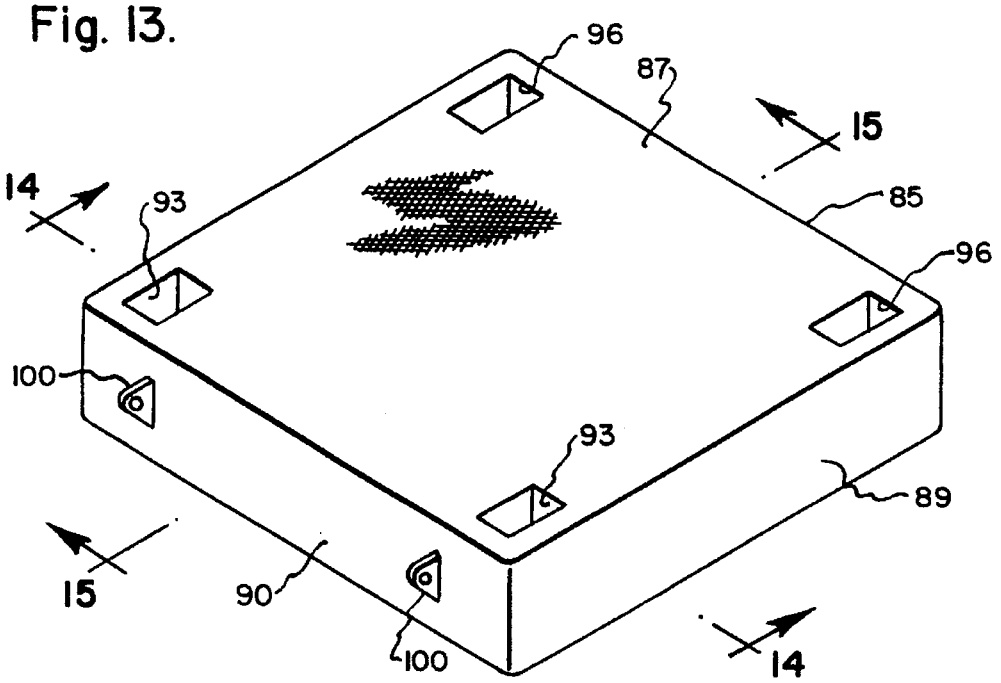
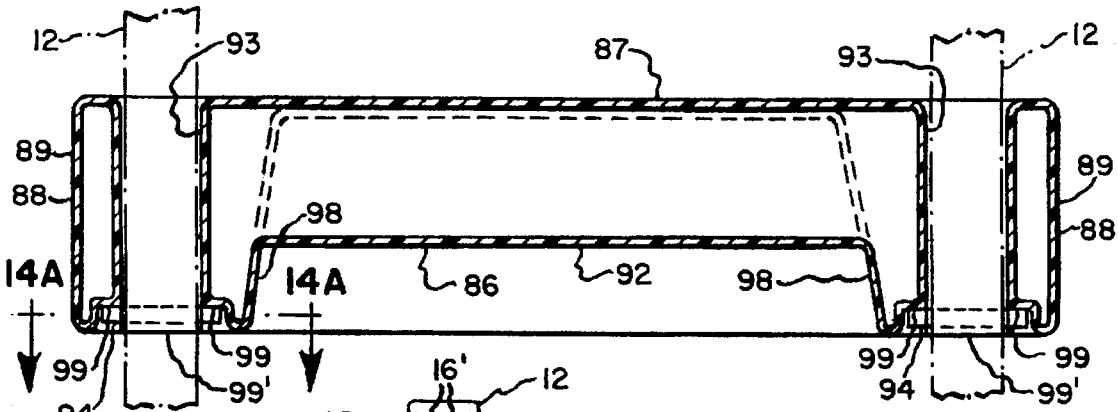
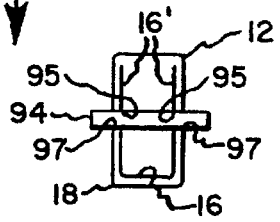
Fig.14A
Fig. 14.
Fig. 15.
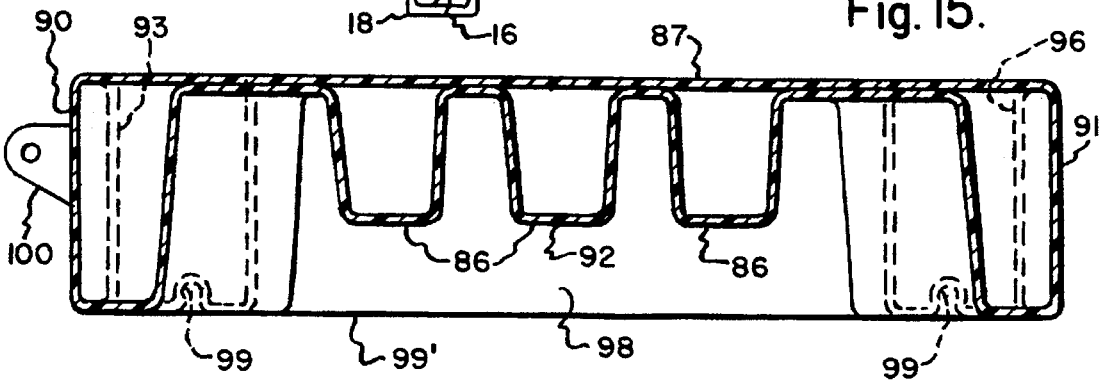

COMBINATION POOL LADDER, FENCE AND ADJUSTABLE MULTI-LEVEL DECK

BACKGROUND OF THE INVENTION

The present invention relates to a combination pool ladder, fence and adjustable multi-level deck for an above-ground swimming pool.

By way of background, one present ladder arrangement for an above-ground swimming pool comprises an A-frame device having a first ladder on the outside of the pool wall and a second ladder on the inside of the pool wall with their upper portions connected to each other. Ladders of this type were deficient in a number of respects. In some constructions ladders of this type required that a fence be built around them on the outside of the pool to prevent unauthorized entry into the pool by the use of the A-frame ladder. In addition, ladders of this type included a deck which was usually placed between the two ladders, and this deck was permanently installed to be located only a few inches above the top of the pool wall. However, since there were many different types of pools having walls of different heights, a different ladder had to be used with each height of pool wall. Furthermore, the A-frame generally had to be connected to the top rail of the pool by a procedure which usually required drilling of holes which formed the focal points for subsequent corrosion inasmuch as the protective coating of the metal was disrupted. Additionally, connecting the A-frame ladder to the top rail of the pool resulted in stressing the related pool structure. Also, in certain instances the A-frame ladder was not attached to the pool structure, and in such instances the ladder was generally unstable and the higher the deck the more unstable was the ladder. Also, in prior pools using an A-frame type of ladder there were no accommodations for attaching the fence rail on top of the pool to the ladder. However, if the ladder was customized to be tied into the fence rail, when the ladder was removed for winterizing, an opening was left in the fence, which, in turn, required the utilization of a temporary fence system to close the opening. In addition, the removal of A-frame type of ladders from the pool for winterizing, constituted a maintenance burden. It was with overcoming the foregoing deficiencies that the present invention is concerned.

SUMMARY OF THE INVENTION

It is one object of the present invention to provide a combination pool ladder, fence and adjustable multi-level deck for an above-ground swimming pool which can be permanently attached to the pool.

Another object of the present invention is to provide a pool ladder construction having a lower deck and an upper deck which facilitates the entry into and exit from the pool.

A further object of the present invention is to provide an improved pool entry construction for an above-ground swimming pool which includes an external ladder leading to the pool which can be pivoted to an out-of-way position when not in use and which thereby also functions as a gate to prevent unauthorized entry into the pool, and which in combination with its supporting frame functions as a fence, thereby obviating the necessity for a separate fence located around the pool entry ladder.

A still further object of the present invention is to provide an improved pool entry structure which can include a self-closing gate, which can close off the pool entry structure both when the pool entry ladder is in place and after it has been removed.

Yet another object of the present invention is to provide an improved pool ladder construction wherein an internal ladder, which is placed into the pool, can be moved out of the pool for winterizing, without requiring that it be disassembled or otherwise physically removed from its supporting structure.

A still further object of the present invention is to provide an improved pool entry structure having a lower deck and an upper deck with the lower deck being at a fixed elevation and the upper deck, which is located above the pool wall, being adjustable in height to a position relatively close to the top of the pool wall to thereby close off any space which may exist between the upper deck and the pool wall.

Another object of the present invention is to provide a single pool entry structure that can be mounted relative to pools of various sizes without the requirement for cutting or drilling of parts or packaging of parts of different sizes, thereby both lessening the need for a large inventory of parts and also simplifying the assembly thereof.

A further object of the present invention is to provide a pool entry structure which is extremely stable.

A still further object of the present invention is to provide an improved pool entry structure which can be easily assembled. Other objects and attendant advantages of the present invention will readily be perceived hereafter.

The present invention relates to a combination pool ladder structure and multi-level deck for an above-ground swimming pool comprising a frame, a first deck mounted on said frame, a first ladder on said frame leading to said first deck, a second deck mounted on said frame at a higher level than said first deck, and a second ladder mounted on said second deck and leading downwardly therefrom.

The present invention also relates to an entry structure for an above-ground swimming pool comprising a frame having first and second sides, a plurality of legs on said frame, a deck on said frame, railings on said frame above said deck and on opposite sides thereof, a space between said railings, a first ladder secured to said first side of said frame and movable between a first position wherein it leads to said deck and to said space between said railings from the ground and a second position wherein it obstructs said space between said railings, and a second ladder secured to said second side of said frame and extending downwardly therefrom.

The present invention also relates to an entry structure for an above-ground swimming pool comprising a frame having first and second sides, a plurality of legs on said frame, a deck on said frame, a first ladder pivotally mounted on said first side of said frame for movement between a first position wherein it extends toward the ground and leads to said deck and a second position wherein it extends away from the ground and obstructs access to said deck, and a second ladder pivotally mounted on said second side of said frame for movement between a first position wherein it extends into a pool and a second position wherein it extends away from the pool and obstructs entry to said pool from said deck.

The various aspects of the present invention will be more fully understood when the following portions of the specification are read in conjunction with the accompanying drawings wherein:

BRIEF DESCRIPTION OF THE DRAWINGS

FIG. 2 is a side elevational view of the combination pool ladder fence and adjustable multi-level deck;

FIG. 2A is a fragmentary cross sectional view taken substantially along line 2A—2A of FIG. 2 and showing a portion of the railing structure;

FIG. 3 is an end elevational view taken substantially in the direction of arrows 3—3 of FIG. 2 and showing the external pool entry ladder located externally of the pool;

FIG. 4 is a combined end elevational view and cross sectional view taken substantially along line 4—4 of FIG. 2 and showing the internal pool entry ladder which is immersed in the pool;

FIG. 5A is a fragmentary cross sectional view taken substantially along line 5A—5A of FIG. 5;

FIG. 5B is a fragmentary cross sectional view taken substantially along line 5B—5B of FIG. 5A;

FIG. 5C is a perspective view of the bracket used to attach the top of the pool entry ladder to the frame;

FIG. 7 is an enlarged cross sectional view taken substantially along line 7—7 of FIG. 2 and showing the structure of the frame legs;

FIG. 8 is a diagrammatic view showing the orientation of the frame legs relative to each other;

FIG. 9 is a fragmentary perspective view of one of the ends of the rails of the railing;

FIG. 10 is a fragmentary perspective view showing the manner in which the rails fit into the frame legs;

FIG. 11 is a fragmentary view of one of the four ends of the frame braces;

FIG. 13 is a perspective view of a blow-molded lower deck which can be used instead of the lower deck of FIGS. 1–12;

FIG. 14 is a cross sectional view taken substantially along line 14—14 of FIG. 13;

FIG. 14A is a cross sectional view of the leg taken substantially along line 14A—14A of FIG. 14;

FIG. 15 is a cross sectional view taken substantially along line 15—15 of FIG. 13;

DESCRIPTION OF THE PREFERRED EMBODIMENTS

Figure 1:
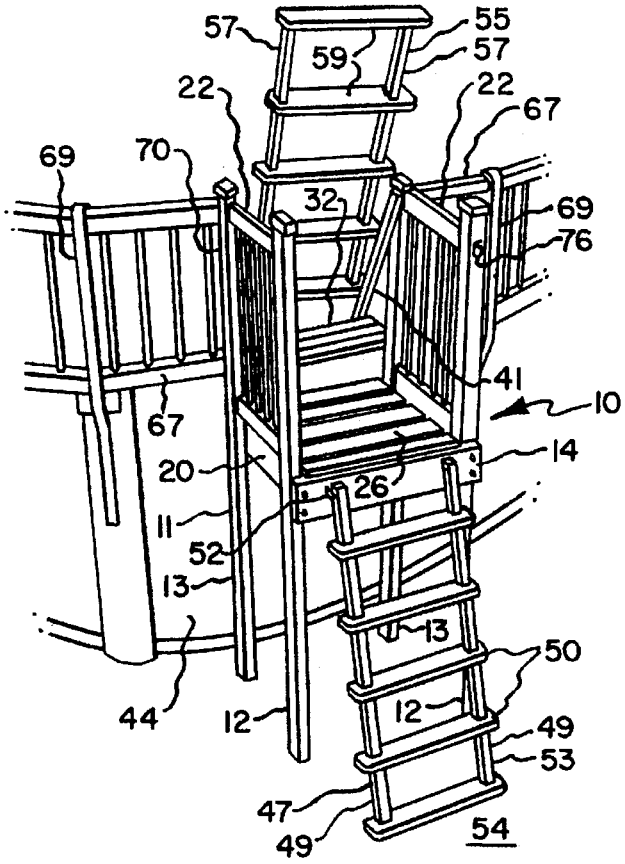
FIG. 1 is a fragmentary perspective view of the combination pool ladder, fence and adjustable multi-level deck mounted relative to the wall of an above-ground swimming pool.

The combination pool ladder, fence and adjustable multi-level deck 10 of the present invention includes a frame 11 consisting of a pair of front legs 12 and a pair of rear legs 13. A beam 14 (FIG. 3) in the nature of a wooden plank is screwed to the front legs 12 by means of spaced apart screws 15. A beam 17 (FIG. 4) in the nature of a wooden plank is secured across the rear legs 13 by means of spaced apart screws 19. A beam 20 (FIGS. 2, 3 and 5) extends between and is attached by screws (not shown) to the insides of each pair of legs 12–13. Beams 14, 17 and 20 could also be vinyl extrusions. The ends of slats 21 are secured, as by staples 26' to spaced boards 28' which lie between and adjacent to beams 20 to thereby provide a lower deck 26. More specifically, staples 26' (FIGS. 5A and 5B) are driven upwardly through each of the boards 28' (FIGS. 5A, 5B and 4), which are located at the opposite ends of each of the slats 21, and the staples are received in the opposite ends of each slat 21. Each board 28' has an outer side 29' which lies adjacent to the inner side 30' of beam 20. The extreme outer ends 31' of each slat 21 rest on beams 20. Thus, the deck 26 rests on beams 20, and the ends of boards 28' lie in contiguous relationship to beams 14 and 17.

Figure 5:
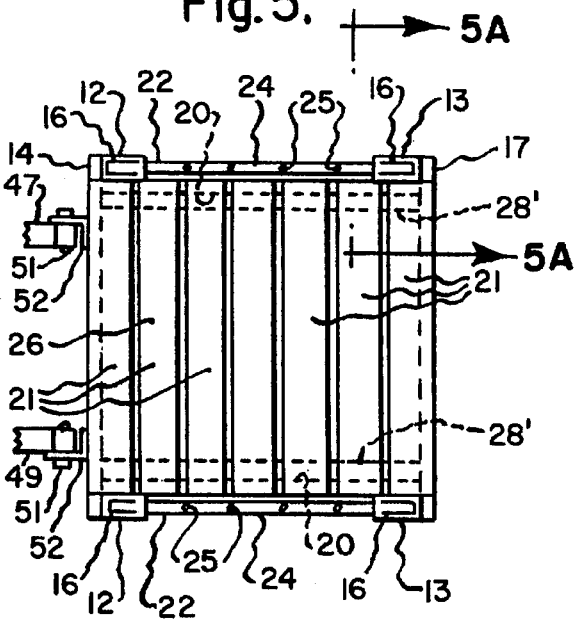
FIG. 5 is a cross sectional view taken substantially along line 5—5 of FIG. 2 and showing the structure of the lower deck.

A pair of railings 22 are provided. Each railing extends between a pair of legs 12–13 (FIG. 5). Each railing 22 consists of an upper rail 23 and a lower rail 24 (FIG. 2), and a plurality of pickets or rungs 25 extend between rails 23 and 24. Rails 23 and 24 are tubular polyvinyl hollow rectangular angular extrusions having holes, such as 27' (FIG. 2A), for receiving the ends of pickets 25. Rails 23 and 24 are identical and they have tangs or tabs 27 (FIG. 9) struck out therefrom which are resilient so that when the ends 29 of the rails are inserted into openings, such as 30 (FIG. 10) of legs 12 and 13, the tangs or tabs 27 will be pressed inwardly as they pass through the openings 30 and they will spring back to the position shown in FIG. 9 to thereby prevent the rails 23 and 24 from being pulled out of the legs 12 and 13.

The legs 12 and 13 are identical and consist of a steel channel 16 within a hollow vinyl rectangular tubular member 18 (FIG. 7). Thus, rails 23 and 24 can enter cutouts, such as 30 (FIG. 10). The channels 16 lend rigidity to legs 12 and 13, and the openings 30 can be cut into members 18 without requiring cutting of channels 16. The steel channels 16 also provide sides to receive the sheet metal screws 15 and 19 and the screws (not shown) which secure beams 20 to legs 12 and 13. Thus, the vinyl tubular members 18 are not relied on for primarily supporting the beams.

Figure 6:
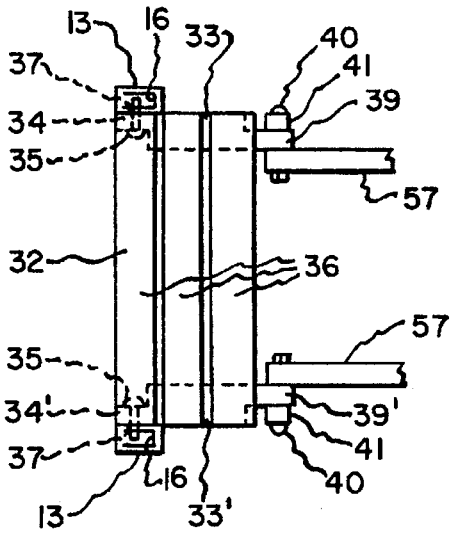
FIG. 6 is a fragmentary cross sectional view taken substantially along line 6—6 of FIG. 2 and showing the upper deck and a portion of the internal pool entry ladder.
Figure 16:
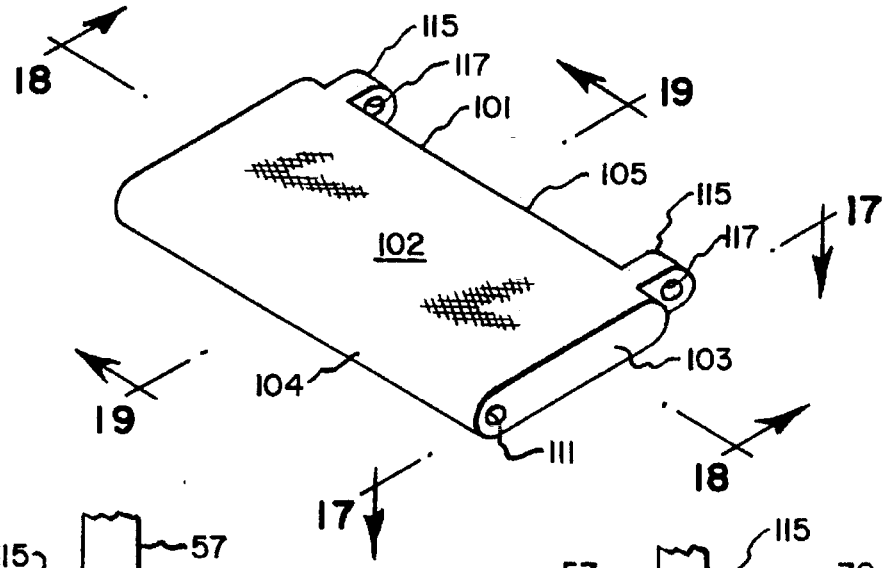
FIG. 16 is a perspective view of a blow-molded upper deck which can replace the upper deck of FIGS. 1–12.
Figure 17:
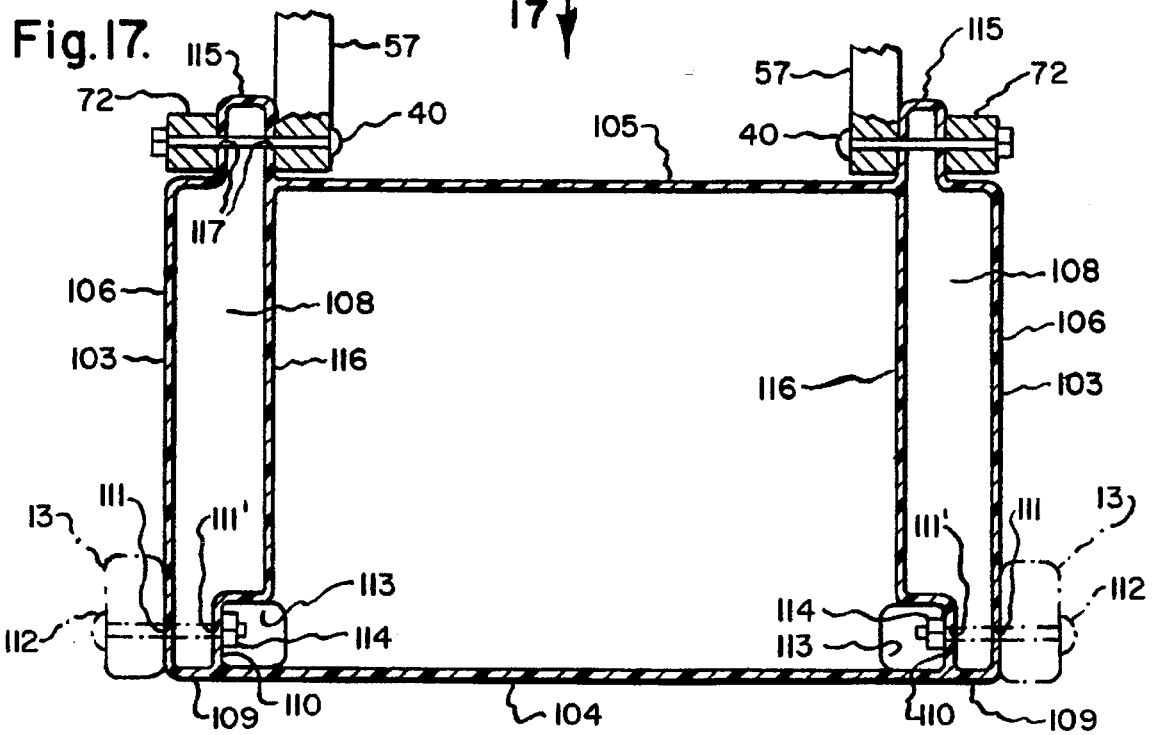
FIG. 17 is a cross sectional view taken substantially along line 17—17 of FIG. 16.
Figure 18:
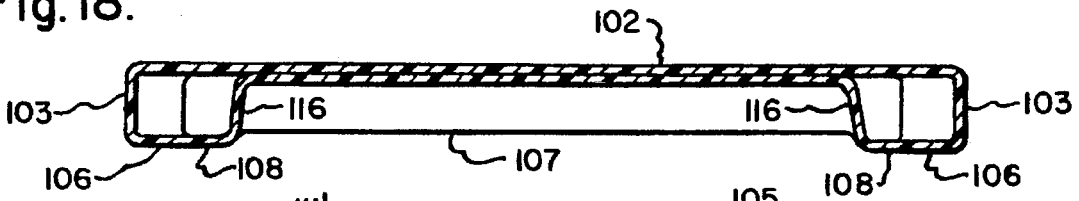
FIG. 18 is a cross sectional view taken substantially along line 18—18 of FIG. 16.
Figure 19:
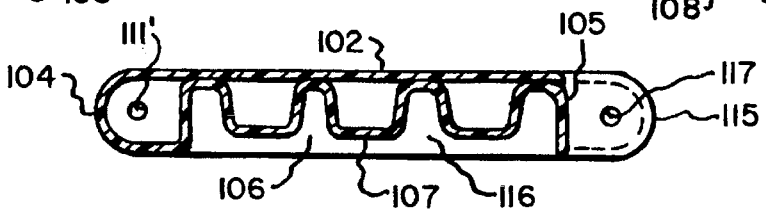
FIG. 19 is a cross sectional view taken substantially along line 19—19 of FIG. 16.

A higher deck 32 (FIGS. 2, 3, 4 and 6) includes spaced side rails 33 and 33', which are mirror image counter-parts and have the configuration in plan shown in FIG. 6. The ends 34 and 34' of rails 33 and 33', respectively, are secured by sheet metal screws 35 to rear legs 13 and each sheet metal screw is anchored in a leg 16' (FIG. 8) of its associated channel 16. The screws pass through a hole 37 (FIGS. 2 and 6) in each of legs 13. The ends 39 and 39' of rails 33 and 33', respectively, receive bolts of the nut and bolt assemblies 40 (FIGS. 2 and 6) which also pass through the lower ends of diagonal braces 41 (FIG. 4), the upper ends of which are secured to rails 13 by sheet metal screws 42 (FIGS. 2 and 4), each of which is anchored in a leg 16' (FIG. 8) of channel 16. A plurality of slats 36 are suitably secured, as by nails, to the tops of rails 33 and 33'. It can be seen that the higher deck 32 is located above the top 43 of pool wall 44 (FIG. 2).

The higher deck 32 is mountable at a plurality of different elevations, and the elevation which is selected depends on the height of pool wall 44'. In this respect, there are pools which have wall heights of 48 inches, 52 inches and 54 inches, and it is desirable to have the higher deck as close to the top 43 of the pool wall as possible. Accordingly, there are two additional sets of holes in legs 13 which correspond to holes 37. More specifically, there is a higher set of holes 44 and a lower set of holes 45 so that the screws 35 can be used to locate the ends 34 and 34' of the rails 33 and 33', respectively, in holes as 44 or 45, as well as in holes 37.

However, in order to cause the higher deck 32 to remain horizontal, two additional holes 46 and 48 (FIG. 2) are located in the lower end of each diagonal brace 41, and these additional holes are used when locating deck 32 at different heights. In the foregoing respect, diagonal 41 simply rotates at screw 42, and bolt 40 is located at its proper position to keep deck 32 horizontal.

An external pool entry ladder 47, which is located outside of the pool wall, includes side rails 49 and rungs or treads 50. The upper ends of rails 49 are pivotally secured by nut and bolt assemblies 51 which pass through holes 52 in suitable brackets 52 (FIG. 5C) which are secured to beam 14 by fasteners (not shown) which pass through holes 51' in brackets 52. Because of this pivotal connection, the lower ends 53 of rails 49 will rest on the portion of ground 54 underneath them regardless of whether the ground is higher or lower than the ground underneath legs 12. The rungs 50 can be mounted on rails 49 in any suitable manner, and preferably in the manner shown in my prior U.S. Pat. No. 4,603,758.

An internal pool ladder 55, which is on the inside of the pool wall, includes a pair of rails 57 and a plurality of rungs or treads 59 which may be mounted on rails 57 in any suitable manner and preferably as shown in prior U.S. Pat. No. 4,603,758. The upper ends of rails 57 are pivotally mounted on nut and bolt assemblies 40 (FIG. 4). Here again, because of the pivotal mounting of rails 57, the lower ends 60 of the rails will settle squarely on the bottom surface 61 of the pool, regardless of its height.

In order to further stabilize the frame 12, a pair of braces 62 are attached between legs 13 and beam 17. Braces 62 are steel tubes with flattened ends 63 (FIG. 11) having holes 64 therein for receiving screws which are anchored in the webs 17' of steel channels 16. Braces 62 are only placed on the rear legs 13 of the frame which are immediately in front of the pool wall so that children cannot climb on them. In fact, there are no protuberances on legs 12 and 13 below deck 26 which can be used as toe holds for children which would enable them to climb onto deck 26.

In use, the entry structure 10 is mounted with rear legs 13 adjacent the outer surface 65 of pool wall 44 (FIG. 2). Railings 67 (FIG. 1) are fastened between pool fence posts 69 and the inner edges 70 of legs 13. Thus, railings 67 close off the spaces outwardly of the upper portions of legs 13. Furthermore, considering the position of upper deck 32 immediately adjacent the top 43 of pool wall 44', there is no space below the decks through which a child, or anyone else for that matter, can enter the pool. Furthermore, because of the pivotal connection between rails 49 and beam 14, ladder 47 can be pivoted from the solid line position shown in FIG. 2 to the dotted line position shown therein wherein keeper 71 mounted on rail 49 will enter gate latch 76. Thus, the entry ladder 47 serves the dual purpose of acting as a gate, as well as a ladder. This ladder acting as a gate closes the space between legs 12 and prevents entry of children into the pool. Thus the ladder 47 acting as a gate in combination with the frame 11 serves as a fence, which obviates the necessity for a separate fence around the pool entry ladder 47. The latch 72 may also have provisions for receiving a lock.

The internal pool ladder 55, by virtue of its pivotal mounting at 40, is movable to dotted line position 55' in response to changing of the elevation of upper deck 32 to position 32'. Also, ladder 55 is pivotable to the position shown in FIG. 1 wherein the outer edges of rungs 59 rest against surfaces 72 of diagonal braces 41. Thus, ladder 55 can be pivoted out of the pool when it is not in use, as when it is closed for the winter, and it also closes the space between legs 13, thereby providing a further safeguard against entry into the pool, especially if a locking mechanism is used to lock ladder 55 in its elevated position. Additionally, if desired, ladder 55 may be detached from deck 32 and removed from the pool, without requiring removal of the frame 11.

Figure 12:
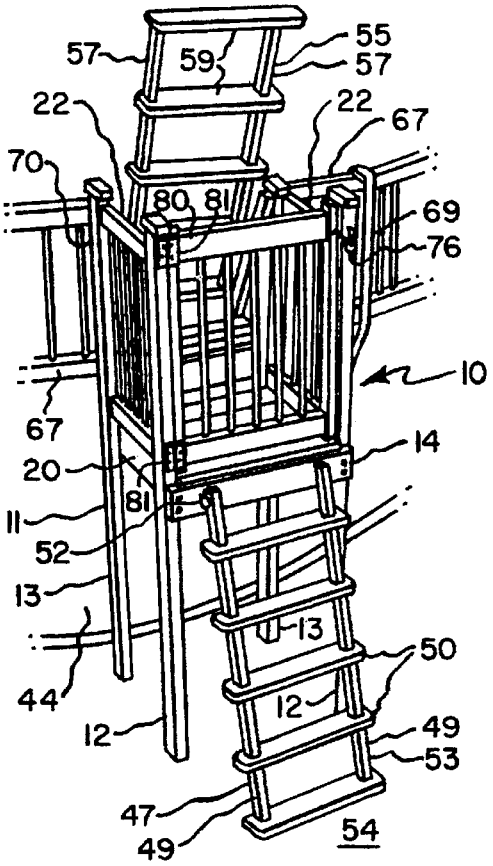
FIG. 12 is a fragmentary perspective view of an alternate embodiment of the present invention.

In FIG. 12 a modified embodiment of the present invention is disclosed wherein a gate 80 is mounted by spring loaded hinges 81 on the upper portion of leg 12 and the opposite end of gate 80 may have a latch thereon to provide a self-closing gate to further prevent unauthorized entry into the pool. In the foregoing embodiment, the external ladder 47 may be detached from frame 11, if desired.

As stated above, wherever a structural member is secured to legs 12 and 13 by a sheet metal screw, the screw is anchored in a leg 16' or web 17' of channel 16 located within vinyl tubular member 18. The pointed end of each sheet metal screw is contained within channel 16, and the only exposed part of the screw is its head.

In FIGS. 13–15 a blow-molded polyethylene lower deck 85 is shown which is an alternate to lower deck 26 of FIGS. 1–12. Deck 85 includes a substantially flat upper surface 87 which has a tread thereon. It also includes side walls 89, front wall 90 and rear wall 91. It also includes a bottom wall 92 which is formed in corrugated shape (FIG. 15), and the tops of the corrugations abut the underside of top wall 87 to reinforce it. Box structures 88 extend along the sides of deck 85 and include side walls 89 and inner walls 98, along with the outer portions of upper surface 87 and lower surfaces 99'. The ends of corrugations 86 of bottom wall 92 extend into inner walls 98. Openings 93 are formed in deck 85 as shown to receive front legs 12, and the walls of openings 93 are continuous and extend between upper surface 87 and lower surface 99' of box structures 88. Pins 94 are inserted through holes in legs 12, and more specifically there are holes 95 (FIG. 14A) in legs 16' of channels 16 and holes 97 in the vinyl tubular member 18 of leg 12. The ends of pins 94 are received in recesses 99 formed in the lower surface 99' of deck 87. Legs 12 fit into holes 93 with a tight fit. Brackets 100 are molded integrally with front wall 90 of deck 87 for receiving bolts 51 (FIG. 3) for securing the ladder 47 to the remainder of the structure. Openings 96 are formed in deck 85 to receive rear legs 13 with a tight fit, and deck 85 is mounted on legs 13 by pins 94 in the same manner as described in FIG. 14A. The walls of openings 96 are continuous and extend between upper surface 87 and lower surface 99' of box structures 88. It will be appreciated that the blow-molded deck 87 would not only replace deck 26 but would also replace beams 14, 17 and 20, and also brackets 52 (FIGS. 5 and 5C).

In FIGS. 16–19 a blow-molded polyethylene upper deck 101 is shown which is an alternate to upper deck 32 of FIGS. 1–12. Deck 101 includes an upper surface 102 having a tread thereon, side walls 103, front wall 104, rear wall 105 and corrugated bottom wall 107, and the tops of the corrugations abut the underside of top wall 102 to reinforce it. Box structures 106 extend between front wall 104 and rear wall 105 and include side walls 103, bottom wall portions 108, and bottom wall portions 116. Corrugated bottom wall 107 extends between box wall portions 116. Ears 109 are formed at the ends of box structures 106 and are located proximate front wall 104. Side walls 103 of the deck and surfaces 110 of ears 109 have holes 111 and 111', respectively, therein for receiving bolts 112 for fastening deck 101 to legs 13, the bolts passing through holes such as 44 (FIG. 8) in legs 13. The pockets 113 adjacent ears 109 receive the nuts 114 so that they are not exposed. Ears 115 extend outwardly from rear wall 105 at the ends of box structures 106 for attachment between diagonal braces 72 and ladder rails 57. Bolts 40 extend through holes 117 in ears 115 and holes such as 46 and 48 of diagonal braces 72 and the holes (not numbered) at the tops of pool entry ladder rails 57. Alternatively, ears 109 may be secured to legs 13 in the same manner as shown in FIG. 6.

While preferred embodiments of the present invention have been disclosed, it will be appreciated that it is not limited thereto but may be otherwise embodied within the scope of the following claims.

What is claimed is:

1. A combination pool ladder structure, fence and adjustable multi-level deck in combination with an above-ground swimming pool having a wall which extends above the level of the ground and has a top and an external side and an internal side, said combination pool ladder structure, fence and adjustable multi-level deck comprising a frame mounted adjacent said external side, a first deck mounted on said frame below the level of said top of said pool wall and outside of said external side of said pool wall, a first ladder pivotally mounted on said frame and being selectively movable between a first portion wherein it extends between the ground and said first deck and a second position wherein it extends upwardly above said first deck, a second deck mounted on said frame and located above said top of said pool wall, and a second ladder pivotally mounted on said second deck and being selectively movable between a first position proximate said internal side wherein it extends into said pool and a second position wherein it is located in an elevated position above said pool wall and obstructs entry into said pool from said second deck.

2. A combination pool ladder structure and multi-level deck for an above-ground swimming pool comprising a frame, a first deck mounted on said frame, a first ladder on said frame leading to said first deck, a second deck mounted on said frame at a higher level than said first deck, and a second ladder mounted on said second deck and leading downwardly therefrom, said first ladder and said first deck and said second deck and said second ladder all being in alignment.

3. A combination pool ladder structure and multi-level deck as set forth in claim 2 wherein the level of said second deck is adjustable relative to said first deck.

4. In an above-ground swimming pool having a pool wall which extends above the level of the ground and has a top and an external side and an internal side, a combination pool ladder and adjustable multi-level deck comprising a frame located adjacent said external side, a first deck mounted on said frame outside of said external side of said pool wall and located at a level below the top of said pool wall, a first ladder mounted on said frame and extending between the ground and said first deck, a second deck mounted on said frame and located above said top of said pool wall, and a second ladder mounted on said second deck and extending into said pool.

5. In an above-ground swimming pool as set forth in claim 4 wherein the level of said second deck is adjustable relative to said top of said pool wall.

6. In an above-ground swimming pool as set forth in claim 5 wherein said first ladder is pivotally mounted on said frame.

7. In an above-ground swimming pool as set forth in claim 5 wherein said second ladder is pivotally mounted on said second deck.

8. In an above-ground swimming pool as set forth in claim 7 wherein said first ladder is pivotally mounted on said frame.

9. An entry structure for an above-ground swimming pool comprising a frame having first and second sides, a plurality of legs on said frame, a first deck on said frame, a first ladder pivotally mounted on said first side of said frame for movement between a first position wherein it extends toward the ground and leads to said first deck and a second position wherein it extends away from the ground and obstructs access to said first deck, a second deck on said second side of said frame located at a higher elevation than said first deck, and a second ladder pivotally mounted on said second side of said frame proximate said second deck for movement between a first position wherein it extends into a pool and a second position wherein it extends away from the pool and obstructs entry to said pool from said second deck, and said second deck being selectively securable to said second side of said frame at a plurality of elevations.

10. An entry structure for an above-ground swimming pool as set forth in claim 9 including railings on said frame above said deck and on opposite sides thereof.

11. An entry structure for an above-ground swimming pool as set forth in claim 9 including a diagonal brace structure between said second side of said frame and said second deck.

12. An entry structure for an above-ground swimming pool as set forth in claim 11 including railings on said frame above said deck and on opposite sides thereof.

13. A combination pool ladder structure, fence and adjustable multi-level deck in combination with an above-ground swimming pool having a wall which extends above the level of the ground and has a top and an external side and an internal side, said combination pool ladder structure, fence and adjustable multi-level deck comprising frame means mounted adjacent said external side, first deck means mounted on said frame means below the level of said top of said pool wall and outside of said external side of said pool wall, first ladder means pivotally mounted on said frame means and being selectively movable between a first portion wherein it extends between the ground and said first deck means and a second position wherein it extends upwardly above said first deck means, second deck means mounted on said frame means and located above said top of said pool wall, second ladder means pivotally mounted on said second deck means and being selectively movable between a first position proximate said internal side wherein it extends into said pool and a second position wherein it is located in an elevated position above said pool wall and obstructs entry into said pool from said second deck means, and means for adjusting the position of said second deck means relative to the top of said pool wall.

* * * * *